United States Patent [19]

Basseches

[11] Patent Number: 4,551,039

[45] Date of Patent: Nov. 5, 1985

[54] BINDER ASSEMBLY WITH RANDOMLY REMOVABLE LEAVES

[76] Inventor: Mark T. Basseches, 420 Lexington Ave., New York, N.Y. 10017

[21] Appl. No.: 653,459

[22] Filed: Sep. 24, 1984

[51] Int. Cl.[4] ..... B42F 3/04; B42F 13/16

[52] U.S. Cl. ..... 402/60; 402/79; 402/501

[58] Field of Search ..... 402/59, 60, 71, 79, 402/501

[56] References Cited

U.S. PATENT DOCUMENTS

| | | | |
|---|---|---|---|
| 1,025,468 | 5/1912 | Housh | 402/501 X |
| 1,371,459 | 3/1921 | Amlie | 402/79 |
| 2,332,606 | 10/1943 | Scholfield | 402/501 X |

FOREIGN PATENT DOCUMENTS

| | | | |
|---|---|---|---|
| 1217922 | 6/1966 | Fed. Rep. of Germany | 402/501 |
| 915365 | 11/1946 | France | 402/79 |
| 115542 | 7/1926 | Switzerland | 402/59 |
| 643124 | 9/1950 | United Kingdom | 402/79 |

*Primary Examiner*—Paul A. Bell

*Attorney, Agent, or Firm*—Mark T. Basseches; Paula T. Basseches

[57] ABSTRACT

A binder assembly comprises a binder and leaves which are randomly removable therefrom. The leaves may be removed only by a sidewise shifting movement. Blocking portions are movably mounted on the device selectively to permit or prohibit sidewise movement of the leaves.

12 Claims, 5 Drawing Figures

FIG. 1
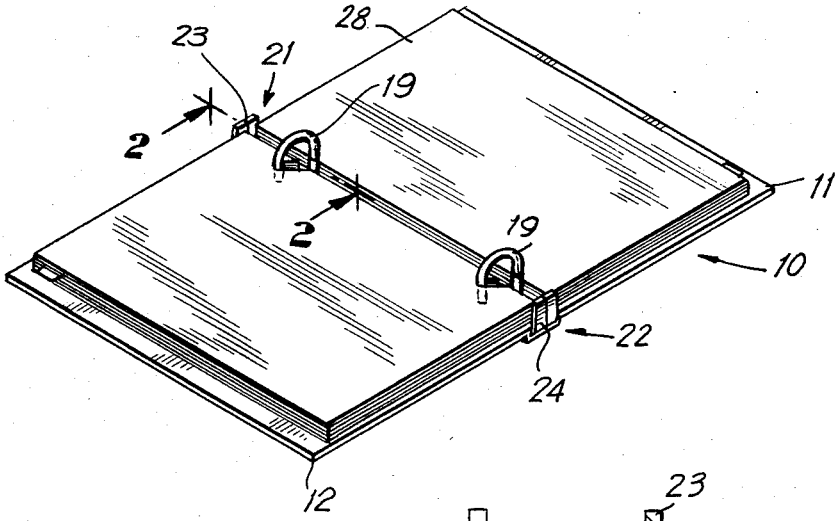
FIG. 2
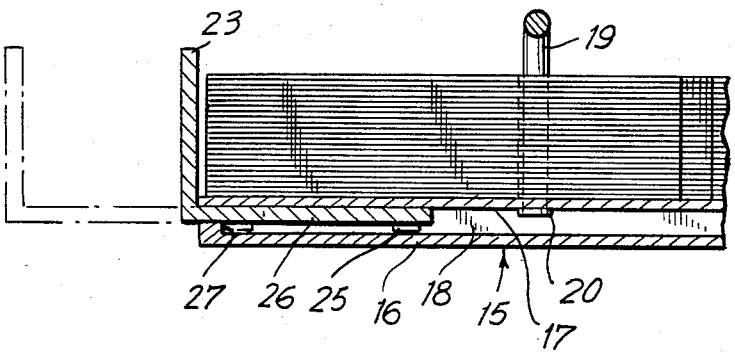
FIG. 3
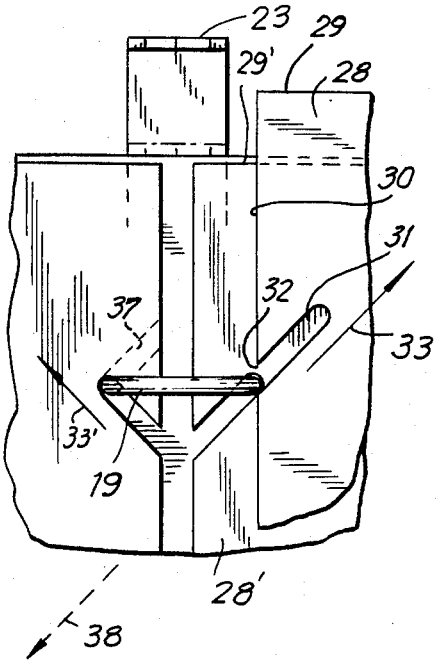
FIG. 4
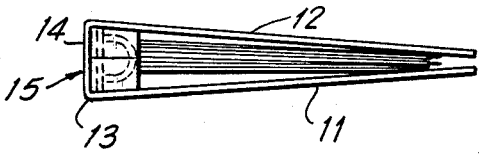
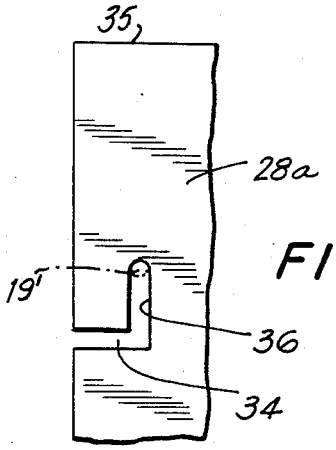
FIG. 5

BINDER ASSEMBLY WITH RANDOMLY REMOVABLE LEAVES

BACKGROUND OF THE INVENTION

1. Field of the Invention

The present invention is directed to a binder assembly or the like, the term "binder assembly" as used herein being employed in a broad context to encompass conventional notebook type binders as well as other types of tabulating systems having removable retaining leaves, such as index card holders, etc.

2. The Prior Art

Conventional binder assemblies, such as looseleaf binders, are comprised of a backing member or spine, to which is movably mounted a leaf holder mechanism typically in the form of a split ring or the equivalent. In the closed or leaf carrying position, the component or components defining the ring provide a closed loop or series of loops which pass through an aperture or apertures of the leaves. In order to remove a given leaf, the holder mechanism is actuated so as to split the loop, whereby any of the leaf or leaves adjacent the open ends of the loop may be removed.

If it is desired to remove a given leaf, typical practice requires that the leaf to be removed be disposed uppermost, the rings opened and the leaf extracted. This procedure is readily effected where there are relatively few leaves mounted in the binder and it is thus possible to align the leaf to be removed with the split of the ring.

However, where a large quantity of leaves are mounted in the binder it may be impossible to align a particular leaf which is desired to be removed with the opening between the split rings. Under such circumstances removal of the leaf in question requires that a multiplicity of intervening leaves be first removed.

This procedure is time consuming and, in addition, the remounting of the multiple leaves necessarily removed is a cumbersome task since the apertures in the mass of leaves to be replaced must first be mutually aligned before remounting.

Conventional split ring type binders are further disadvantageous in that the snap mechanism may frequently fail. Also, the distal ends of the rings in the closed position frequently do not provide a smooth interfit or transition, with the result that when leaves are shifted across the transition, increments of the paper adjacent the mounting apertures are sawed or worn away.

In a further conventional type of tabulating device frequently used for holding index cards, the cards are punched with non-reentrant configurations. The holder mechanism includes complementally shaped bars or rods, the cards being mounted be deforming or flexing the cards to permit the rods to enter the apertures of the cards.

Tabulating devices of this sort are disadvantageous where a card must be periodically removed and replaced since with each mounting and demounting the material of the card is flexed and its connection to the holder thus rendered less secure.

SUMMARY OF THE INVENTION

The present invention may be summarized as directed to an improved binder or like tabulating device and an assembly including combined binder and leaves.

A characterizing feature of the devices resides in the provision of a mounting mechanism for leaves which includes one or more loops which are preferably continuous rather than split, in combination with means for limiting movement of leaves mounted on the loops in a direction normal to the plane of the loops.

The leaves include mounting slots which exit to a margin of the leaves, the slots being directed in such manner that the leaves can be removed only by shifting the same in a plane normal to the plane of the loop. In order to effect removal, a blocking mechanism which normally precludes movement of the leaves in the plane normal to the loops is cleared from the path of the leaves, whereby the same may be readily removed.

The described arrangement enables the removal of any selected leaf from any position within the binder without removal of any other leaf or leaves since the mechanism does not depend upon the opening and closing of split rings and the alignment of a given leaf with the split.

Additionally, by providing movable blocking means at both ends of the holding mechanism and providing leaves punched in diverging patterns, it is made possible to permit certain leaves to be removed when one blocking mechanism is actuated while other of the leaves cannot be removed. For instance, separator or index leaves may be removed by manipulating one blocking means without permitting removal of intervening leaves.

It is accordingly an object of the invention to provide a random leaf removable binder assembly including a binder and a plurality of leaves which may be selectively mounted therein or demounted, the assembly permitting removal of any given leaf without the necessity for removing any other leaf.

A further object of the invention is to provide an improved binder of the type described including a loop defining holder mechanism which need not be of the split ring type, with the consequent elimination of the inherent disadvantages of split rings and their associated actuating mechanisms.

To attain these objects and such further objects as may appear herein or be hereinafter pointed out, reference is made to the accompanying drawings forming a part hereof in which:

FIG. 1 is a perspective view of a notebook embodying a binder assembly in accordance with the invention;

FIG. 2 is a magnified vertical section taken on the line 2—2 of FIG. 1;

FIG. 3 is a fragmentary plan view of an increment of a leaf holding component in the leaf removable position thereof;

FIG. 4 is an end elevational view of the device of FIG. 1;

FIG. 5 is a fragmentary plan view of an alternate punching pattern for a leaf to be used with the apparatus of the invention.

Referring now to the drawings, there is disclosed in FIG. 1 a binder assembly 10 which in this instance is embodied in a notebook but which, as will be readily recognized, may be adapted for holding index cards or like tabular systems.

The binder 10 may include the usual covers 11, 12, hingedly connected as at 13, 14, respectively, to a back or spine 15.

The spine 15, which is axially elongate, may be of double wall construction, as best seen in FIG. 2, including a back wall 16 and an upper wall 17 forming a slideway 18 therebetween. To the upper wall 17 there are mounted one or more holder members 19 which, in the illustrated embodiment, may be in the configuration of inverted "U"s. The free ends of the "U"s are staked as at 20 to the upper wall 17. Mounted within the slideway 18 at the distal ends 21, 22 of the spine are blocker members 23, 24, respectively, at least one of which and preferably both of which are movable toward and away from holder members 19.

As best seen in FIG. 2, the blocker member 23 (the blocker member 24 being preferably similarly mounted) is shiftable between a leaf holding position (solid lines) and a leaf releasing position (dot and dash lines) .

In order to prevent removal of the blocker member 23 and in order that the same may be maintained in one of the two limiting positions shown, a tang 25 may be struck from the lower leg 26 of the blocker member which shifts within slideway 18. The tang provides a frictional resistance to movement of the blocker member 23 and also acts to define with shoulder 27 of back wall 16 a limiting stop to preclude outward movement of the blocker member beyond the dot and dash position of FIG. 2.

The configuration of the leaves to be employed with the binder device and the interaction of the leaves with the binder is best appreciated from FIG. 3.

In accordance with the invention, a representative leaf 28 may include side marginal edge 29 and inner marginal edge 30.

The leaves 28 are punched with mounting slots 31 which include exit portions 32 at the interface with the inner marginal edge 30. The slots 31 include components extending away from the marginal edge 30 and also toward the side marginal edge 29.

Referring again to FIG. 3, a first leaf 28' is shown in mounted position on the holder member 19. As will be apparent, when the blocker member 23 is positioned in abutting relation to the side marginal edge 29' of the sheet 28' (the dot and dash position, FIG. 3) it will be impossible to remove the leaf 28' without intentionally tearing the sheet. In order to permit removal of the sheet it is merely necessary to shift the blocker 23 to the solid line position. At this position the side marginal edge 29' is cleared from the blocker member, whereupon the sheet may be removed in the direction of the arrow 33.

In other words, so long as the blocker member 23 lies adjacent the marginal edge 29' of the sheet or sheets, the sheets may not move in a direction including components axially of the spine and are thus securely retained in the binder. However, as soon as the blocker member is shifted away from the sheets, it is possible to remove any sheet or sheets in the direction of the arrow 33 (or in the case of sheets mounted on the lefthand side of holder members 19, in the direction of the arrow 33').

It is further to be noted that since there is no requirement that any given sheet be disposed adjacent a split, it is possible to remove, for instance, the sheet closest to the cover 11 without removing any adjacent sheets.

Such an operation is impossible with a conventional split ring binder where the quantity of leaves mounted on the binder is such that a given leaf cannot be aligned with the split.

In FIG. 5 there is disclosed an alternate punching configuration wherein the slot 34 extends parallel to side edge 35 of the sheet **28*a* for a distance and then in the area 36 in a direction parallel with the axis of the spine 15**.

In order to remove a sheet **28*a***, it is necessary first to shift the sheet in a direction aligned with the axis of the spine and thereafter in a direction perpendicular to the axis of the spine.

Referring again to FIG. 3, it is feasible to punch certain sheets with slots 37 (see dash lines) which are angularly oriented in a direction opposite to or offset from the slots 31. As will be evident from an inspection of FIG. 3, shifting of the blocking member 23 to the release position (shown in solid line) will not permit the removal of a leaf whose slot is directed in the manner of 37. Rather, such leaf can be removed only by an outward shifting of the blocking member 24, i.e. in the direction of the arrow 38.

By combining sheets punched with slots diverging in the manner of slots 31 and 37, it is possible, for instance, to mount certain separator sheets in a manner in which they will not be inadvertently demountable when the blocker, e.g. 23, is shifted to the release position, but may be readily demounted when the blocker 24 is withdrawn.

By the instant construction there is no disadvantage in completely filling a binder since it is possible to extract any leaf without the necessity for extracting any other leaf. This is in contrast to conventional ring binders which are typically utilized to less than full capacity, such underutilization being necessitated by the desire to avoid demounting a packet of leaves to enable extraction of an otherwise inaccessible leaf.

As will be readily apparent to those skilled in the art and familiarized with the instant disclosure, details of construction of the illustrated embodiment may be readily modified without departing from the spirit of the invention. By way of example, the blocking members 23, 24, while illustrated as being slidably moveable, may equally be pivotal, retractable, etc.

Also, the loops, while illustrated and described as U-shaped, may be circular, etc., and the term "shaped" is thus to be construed in this context.

Additionally, while the loops or holders 19 are illustrated as comprising fixed or closed loops, it is feasible to combine the features of the instant binder with the construction of a conventional snap-open binder.

Accordingly, the invention is to be broadly construed within the scope of the appended claims.

Having thus described the invention and illustrated its use, what is claimed as new and is desired to be secured by Letters Patent is:

1. A binder device actuatable to enable the random extraction of leaves mounted to said device comprising an elongate spine, at least one generally U-shaped left holder member projecting upwardly from said spine in a plane normal to the longitudinal axis thereof and defining with said spine a closed loop, a blocker member movably mounted to said spine in spaced relation to said holder member, said blocker member being shiftable between a leaf blocking position whereat said blocker member is positioned to prevent movement of leaves mounted on said holder member in the direction of the axis of said spine, and a leaf releasing position whereat leaves mounted on said holder are shiftable in the direction of said axis.

2. A device in accordance with claim 1 wherein said spine includes distal end portions and said blocker member is mounted adjacent one said distal end portion.

3. A device in accordance with claim 2 and including a second blocker member disposed at the other distal end of said spine.

4. A device in accordance with claim 3 wherein said second blocker member is mounted to said spine for movement toward and away from said holder member.

5. A device in accordance with claim 3 and including a notebook having front and rear covers and a back portion, said spine of said binder device being fixed to said back portion.

6. A binder device in accordance with claim 3 and including a plurality of leaf members, said leaf members including upper and lower side edges disposed respectively in abutting relation to said blocker member and said second blocker member whereby said leaf members are constrained against movements in the direction of said spine, and an inner edge extending between said side edge, a slot formed in each said leaf member, said slots having exits at said inner edges, said slots extending away from said inner edges and toward one of said side edges, said holder member extending through said slot at a position displaced from said exits in the direction of one of said side edges.

7. A binder device in accordance with claim 6 wherein the slots of certain of said leaves extend toward one of said side edges and the slots of others of said leaves extend to the other of said side edges.

8. A binder assembly enabling random leaf removal including a binder device and a plurality of leaves removably mounted thereto, said binder device including an elongate spine, a generally U-shaped leaf holder member projecting upwardly from said spine at an intermediate position along said spine in a direction normal to the longitudinal axis thereof, said holder member defining with said spine a closed loop, a blocker member movably mounted to said spine in spaced relation to said holder member, a plurality of leaves mounted on said holder member, said leaves including side marginal edge portions in abutting relation to said blocker member and inner marginal edges, a slot formed in said leaves, said slots including exit portions at said inner marginal edges and components extending away from said exit portions and toward said side marginal edge portions, said holder member extending through said slots at positions displaced from said exit portions in the direction of the axis of said spine, said blocker member being movable to a release position away from said abutting relation to said leaves whereby selected said leaves may be shifted in the direction of the axis of said spine without interference from said blocker member when the latter is in said release position.

9. A binder assembly in accordance with claim 8 and including a second blocker member on said spine in spaced relation to said blocker member, the opposed side marginal edges of said leaves being disposed in abutting relation with said blocker member and said second blocker member, respectively.

10. A binder assembly in accordance with claim 9 wherein said second blocker member is shiftable relative to said spine in a direction away from said holder member.

11. A binder assembly in accordance with claim 10 wherein the slots of certain of said leaves extend toward one said side marginal edge and the slots of others of said leaves extend toward the other said side marginal edge.

12. A binder assembly in accordance with claim 8 and including a notebook having front and rear covers and a back portion, said spine being fixed to said back portion.

* * * * *